US005091022A

United States Patent [19]

Achikita et al.

[11] Patent Number: 5,091,022

[45] Date of Patent: Feb. 25, 1992

[54] MANUFACTURING PROCESS FOR SINTERED FE-P ALLOY PRODUCT HAVING SOFT MAGNETIC CHARACTERISTICS

[75] Inventors: Masakazu Achikita, Kashiwa; Akihito Ohtsuka, Sakura, both of Japan

[73] Assignee: Sumitomo Metal Mining Company, Limited, Tokyo, Japan

[21] Appl. No.: 555,843

[22] Filed: Jul. 19, 1990

[30] Foreign Application Priority Data

Jul. 21, 1989 [JP] Japan ..... 1-187312

[51] Int. Cl.[5] ..... H01F 1/02

[52] U.S. Cl. ..... 148/104; 419/10; 419/23; 419/25; 419/36; 419/37; 419/39

[58] Field of Search ..... 148/104; 419/10, 23, 419/25, 36, 37, 39

[56] References Cited

U.S. PATENT DOCUMENTS

| | | | |
|---|---|---|---|
| 3,836,355 | 9/1974 | Lindskog et al. | 75/0.5 BA |
| 4,047,983 | 9/1977 | Falkowski et al. | 148/105 |
| 4,115,158 | 9/1978 | Reen | 419/10 |
| 4,236,945 | 12/1980 | Reen | 148/105 |

*Primary Examiner*—John P. Sheehan
*Attorney, Agent, or Firm*—Wall and Roehrig

[57] ABSTRACT

There is disclosed a method for manufacturing intricate shaped magnetic parts having excellent soft magnetic characteristics which includes forming powders of Fe and P having particle sizes less than 45 μm; mixing 0.1 to 1.0% by weight P powder with Fe powder; adding a binder; injection-molding the mixture at 1200 kg/cm$^2$; removing the binder by heating; sintering the binder free part at 1200°-1400° C. for 30-180 min; and cooling the sintered part at a rate of less than 50° C./min.

9 Claims, No Drawings

MANUFACTURING PROCESS FOR SINTERED FE-P ALLOY PRODUCT HAVING SOFT MAGNETIC CHARACTERISTICS

BACKGROUND OF THE INVENTION

This invention relates to a process for manufacturing an iron-phosphorous (Fe-P) alloy, and more particularly to a process for manufacturing a high density iron-phosphorous sintered powdered metal (Fe-P) alloy having excellent soft magnetic characteristics.

Fe-P alloy with its high magnetic permeability is widely utilized as a head-yoke material for an iron magnetic core dot-printer including a magnetic switch. In general, these devices have a relatively complicated shape, so that conventional plastic molding cannot be used to manufacture them. Also, traditional machining processes for producing them are very costly.

Therefore, according to the conventional processes, a molten Fe-P alloy is poured into a ceramic die and the solidified product is removed from the cavity of the ceramic die after cooling. This process is known as precision casting. However, since this precision casting requires melting of the metal alloy, in some cases undesired precipitation takes place during the solidification process and variations in porosity will be encountered inside the cast products. Hence, it is extremely difficult to reliably produce products having uniform excellent soft magnetic characteristics.

Several attempts have been made to overcome these technical drawbacks by employing powdered metallurgy methods to the forming of Fe-P alloy products. Since the conventional method for forming powder metallurgy products uses press-forming, a complete and perfect composition is hardly ever achieved, even if a large pressure is applied during the forming processes, because cracks will be formed due to these high compressive forces during sintering of the green powder.

In other methods, since the Fe powder has a relatively large average particle size, it has been proposed to mix a fine particle powder of either P or Fe-P into the Fe powder. However, when the prepared pressed-green product is sintered, the final relative density can be increased only up to 92–93% at most. Moreover, because coarse Fe powder is used, the mixing of P powder with the Fe powder is insufficient, resulting in non-uniform distribution of P powder. It is generally believed that the soft magnetic properties of the alloy are further degraded by an increasing degree of porosity and the non-uniform distribution of P powder. Consequently, the products made through the above powder metallurgy are found to possess less desirable characteristics than those manufactured by a melting process.

OBJECTS AND SUMMARY OF THE INVENTION

Accordingly, it is an object of this invention to provide a process for manufacturing a high density sintered Fe-P alloy having excellent soft magnetic characteristics while overcoming the aforementioned drawbacks. It is another object of the present invention to provide a process for manufacturing a powdered metal sintered Fe-P alloy product having improved uniform soft magnetic characteristics that is easily accomplished in an economical fashion.

The above objects of this invention, after extensive and diligent efforts on research and development, are achieved in a preferred embodiment by injection-molding a selected Fe-P-binder powder mixture, heat-treating the molded product to remove the binder material, sintering the binder-removed product, and cooling the sintered product at a predetermined rate. According to the concept of this invention, a compound comprising binder material and a mixture of 0.1~1.0% by weight of P powder with the balance Fe powder, with both having an average particle size less than 45 μm, is first injection-molded. The molded product is then heat treated to remove the binder material. The binder-removed product is then sintered at a selected temperature for a pre-determined time, followed by a cooling period at a rate of less than 50° C./min to produce a sintered product of Fe-P alloy showing excellent soft magnetic properties.

DETAILED DESCRIPTION OF THE PREFERRED EMBODIMENT

In the practice of the present invention, it is necessary to make a mixture of Fe and P powder containing 0.1~1.0% by weight of P. If P is less than 0.1%, the sintering density can not be improved, resulting in poor soft magnetic properties. On the other hand, if P exceeds 1% by weight, the magnetic flux density saturation point is extremely reduced, so that the material is not practically useful. Although it would be desirable not to include any other elements than Fe and P in the mixture, as long as any third element contaminant does not exceed a limiting range where the magnetic flux density $B_{35}$ of the sintered product under an external magnetic field of $350_e$, is less than 14,000 G, then the final product can be considered as a binary system; i.e., Fe-P alloy system.

It has also been found that the average particle size of the powder must be less than 45 μm. If it exceeds 45 μm particle size, the fluidability of the mixed compound comprising metal powder and binder material is reduced resulting in an impossible mixture for the injection-molding process. Even if it can be injection-molded, it will take substantially longer for the sintering process to be completed. Because of these problems, the final density cannot be enhanced, and the soft magnetic properties will be extremely degraded.

The binder material in this invention can be any type of known binder material compatible with sintering of injection-molded green products including polyethylene or wax. During the process of removing the binder material, a carbon residue may be formed, which, if allowed to penetrate into the Fe-P alloy, will cause a reduction of the soft magnetic properties. Hence, it is preferable to use a wax which produces a minimum of carbon residue during the binder-removal process.

Although any prior art methods including heating or solvent can be employed to remove the binder material, the heating method which requires relatively simple equipment will be suitable when accomplished in either nitrogen gas, hydrogen gas or in a vacuum, particularly for mass production of the product.

Practical sintering of the binder-removed product will be preferably performed at 1200~1400° C. for 30~180 min in either a hydrogen or vacuum atmosphere after the removal of the binder.

Finally, it is necessary to keep the cooling rate, after said sintering process to less than 50° C./min. If the cooling rate is greater than this, lattice distortion may be encountered during the cooling process, which will remain at room temperature, and decrease the soft magnetic characteristics of the product.

The product manufactured in accordance with the foregoing invention shows better soft magnetic characteristics in comparison with products produced by the melting method or the conventional method of powder metallurgy. Consequently, sintered products having an intricate shape can be produced with high permeability and uniform excellent soft magnetic characteristics.

SPECIFIC EXAMPLES

Referring now to Table 1, in test examples 1 through 3 and comparison examples 1 through 4, carbonyl Fe powder having average particle sizes of 5 μm and 50 μm are mixed with Fe-27 weight % P based alloy powder having an average particle size of 40 μm. A wax-type binder of 40% by volume, was added to the indicated mixture of metal powder and a pellet was produced by heating the mixture of the metal powder and the binder at 150° C. The pellet was then injection-molded in an injection molder using an injection pressure of 1200 kg/cm$^2$. The binder material was removed from the molded green product by heating in a nitrogen gas atmosphere at 300° C. The thus obtained green product without the binder material was finally sintered at 1350° C. for two hours, followed by cooling to the room temperature at cooling rates listed in Table 1. A magnetizing coil and search coil were wound fifty turns around the sintered product produced by the above procedures to obtain a B-H hysterisis curve by using a direct self-flux meter to measure the magnetic flux density ($B_{35}$), the coercive force ($H_c$) and the maximum magnetic permeability ($\mu_m$) under an applied external magnetic field of $350_e$. The results of these properties are listed in Table 1.

TABLE 1

| | composition | particle size of Fe powder (μm) | cooling rate after sintering (°C./min) | sinter density (%) | soft magnetic characteristics $B_{35}$ (kG) | Hc ($O_e$) | $\mu_m$ ($G/O_e$) |
|---|---|---|---|---|---|---|---|
| example 1 | 0.3 weight % P—Fe | 5 | 10 | 96 | 15.6 | 1.0 | 7200 |
| example 2 | 0.5 weight % P—Fe | 5 | 10 | 97 | 15.6 | 1.1 | 7600 |
| example 3 | 0.8 weight % P—Fe | 5 | 10 | 98 | 15.4 | 1.3 | 7100 |
| comparison 1 | 0.05 weight % P—Fe | 5 | 10 | 92 | 13.1 | 2.9 | 1900 |
| comparison 2 | 2 weight % P—Fe | 5 | 10 | 98 | 13.0 | 2.9 | 1800 |
| comparison 3 | 0.3 weight % P—Fe | 5 | 100 | 96 | 13.0 | 3.0 | 1950 |
| comparison 4 | 0.3 weight % P—Fe | 50 | 10 | 90 | 12.4 | 2.6 | 1750 |
| comparison 5 | 0.3 weight % P—Fe | 50 | 10 | 93 | 13.5 | 1.9 | 4200 |
| comparison 6 | 0.3 weight % P—Fe | — | — | 100 | 13.7 | 1.6 | 4500 |

In comparison example 5, a mixed powder was pressed under 5 ton/cm$^2$ without adding any binder material. The pressed powder mixture was sintered according to the same procedures as previous examples and tested to measure various magnetic properties. Results of the example 5 are also listed in Table 1.

In comparison example 6, a soft magnetic product was produced by a melting procedure. Without performing any sintering process on this product, it was also subject to various magnetic property measurements. Obtained data are also listed in Table 1.

From the above results obtained by various measurements of magnetic properties, it is found that the sintered product manufactured by the present invention procedure shows a high magnetic permeability, low coercive force, and high magnetic flux density. It is also observed that the sintered product, according to the present invention, possesses excellent soft magnetic characteristics being superior to any products formed by a melting procedure or powder metallurgy methods of the prior art.

While this invention has been explained with reference to the process disclosed herein, it is not confined to the details as set forth and this application is intended to cover any modifications and changes as may come within the scope of the following claims.

What is claimed is:

1. The method of manufacturing a sintered Fe-P powdered metal product having high magnetic permeability and excellent soft magnetic characteristics which comprises the steps of:

preparing powders of Fe and P having particle sizes of less than 45 μm;

preparing a mixture of Fe and P powders having from 0.1 to 1.0% by weight of P and the balance of Fe;

mixing said Fe-P mixture with a binder to form a pellet for injection molding;

injection molding said powder and binder mixture to form a desired product;

removing the binder material from said injection molded product;

sintering said binder free injection molded product; and cooling said product at a rate of less than 50° C./min. to ambient temperature.

2. The method of claim 1 wherein said Fe-P powder is mixed with a binder to form a mix of 40% by volume of binder material.

3. The method of claim 1 further including choosing the binder from either a polyethylene or a wax.

4. The method of claim 1 wherein:

the Fe powder is prepared with a particle size of 5 μm;

the mixture of Fe and P powders is prepared with 0.3% by weight of P; and the sintered product is cooled at a rate of 10° C. per minute.

5. The method of claim 1 wherein:

the Fe powder is prepared with a particle size of 5 μm;

the mixture of Fe and P powders is prepared with 0.5% by weight of P; and the sintered product is cooled at a rate of 10° C. per minute.

6. The method of claim 1 wherein:

the Fe powder is prepared with a particle size of 5 μm;

the mixture of Fe and P powders is prepared with 0.8% by weight of P; and the sintered product is cooled at a rate of 10° C. per minute.

7. The method of claim 1 wherein removing the binder material includes heating the injection molded product at a temperature of 300° C. in an oxygen free atmosphere to drive off the binder material.

8. The method of claim 1 wherein removing the binder material includes heating the injection molded product at a temperature of 300° C. in a nitrogen atmosphere to drive off the binder material.

9. The method of claim 1 wherein said injection molding of said powder and binder mixture is at a pressure of 1200 kg/cm$^2$.

* * * * *